United States Patent [19]

Gotter

[11] 4,279,339

[45] Jul. 21, 1981

[54] SHELL CONTAINER COMPRISING A CENTERING ASSEMBLY

[75] Inventor: Eugen Gotter, Dusseldorf, Fed. Rep. of Germany

[73] Assignee: Hoffman-Werke GmbH, Fed. Rep. of Germany

[21] Appl. No.: 74,988

[22] Filed: Sep. 13, 1979

[30] Foreign Application Priority Data

Mar. 15, 1979 [DE] Fed. Rep. of Germany ..... 2910126

[51] Int. Cl.[3] ..... F42B 37/00

[52] U.S. Cl. ..... 206/3; 206/446

[58] Field of Search ..... 206/583, 592, 3, 446; 220/446, 447, 448, 437, 439, 408; 89/34; 294/102 R, 102 A; 92/23

[56] References Cited

U.S. PATENT DOCUMENTS

| | | | |
|---|---|---|---|
| 1,935,669 | 11/1933 | Rosers | 206/3 |
| 1,969,066 | 8/1934 | Flink | 206/446 X |
| 2,339,298 | 1/1944 | Shepherd | 206/3 |
| 3,032,366 | 5/1962 | Meek | 294/102 A |
| 3,160,061 | 12/1964 | Moy | 206/3 X |

*Primary Examiner*—Allan N. Shoap

*Attorney, Agent, or Firm*—Parmelee, Miller, Welsh & Kratz

[57] ABSTRACT

A tubular housing for a shell comprising an annular support assembly for the shell ogive, the support assembly having a conical support face adapted to the ogive contour. The support assembly comprises ring segments which, in the rest position of the shell, are radially confined but may move with the shell upon the latter being axially pulled out of the housing, the segments thereby becoming radially displaceable so to release the ogive otherwise wedgedly clamped in the support assembly. Stop means are provided to limit axial and radial segment displacement.

9 Claims, 3 Drawing Figures

SHELL CONTAINER COMPRISING A CENTERING ASSEMBLY

FIELD OF THE INVENTION

The invention relates generally to containers for shells, in particular for artillery shells of relatively great caliper, as for naval artillery.

BACKGROUND OF THE INVENTION

Shells to be fired by artillery, for example shipborne guns, are stored in containers of generally tubular form stacked in ammunition chambers of the ship. Each tubular container has a closure lid adjacent the cartridge case end of the shell permitting withdrawal of the shell in axial direction. Since the shell is supported inside the container by a centering ring surrounding the cartridge case and by centering means adapted to the contour of the shell ogive, the shell cannot be radially jarred in the container to facilitate its withdrawal, and sometimes considerable pulling forces must act upon the shell for its withdrawal because wedging occurs at the ogive support, wedging being emphasized by the relatively small conus apex angle of the ogive where it is supported.

It has been tried to facilitate withdrawal of the shell by coating the ogive support with low-friction materials, as nylon, or by provision of a felt cover on the support, but neither proposition has really remedied the drawback explained above.

It is therefore the object of the invention to provive a shell container of the type defined above but designed such that no jamming of the shell ogive in the housing is possible any more regardless of the material used for the ogive support.

SUMMARY OF THE INVENTION

According to the invention, the stationary support ring hitherto used to support the ogive axially and radially is replaced by a support assembly apt to rigidly hold the ogive in a first position—called "rest position" hereinafter—, and in this rest position, the ogive may still form a wedge joint with the supporting means. The latter, however, may readily move together with the shell upon an axial withdrawal force. With the axial displacement, the rigidity of the support assembly will cease and the latter may expand radially so that the shell will be freed for further axial movement. The displacement of the support assembly may be extremely small. Preferably, the support assembly comprises a multiplicity of ring segments which, in the rest position, assume the form of the conventional supporting ring thanks to a confining sleeve which outwardly encircles or surrounds the segments, the contact face between each segment and the sleeve also being preferably conical and coaxial with the shell axis but with an apex angle sufficiently great to render wedging impossible.

An important aspect of the invention is the manner in which such ring segments are manufactured. A least expensive method is to mold an annular blank of, say, an aluminum alloy and to machine the inner and outer contact faces on a lathe. Again for reasons of cost reduction, the machining will be made successively for the inner and outer surface, and most probably, the blank must be released from the lathe chuck twice. Therefore, axial and/or angular misalignment of the two surfaces cannot be avoided, but this is harmless as long as the segments made from such blank will, when assembled, assume the same sequence as they had in the blank. Therefore, the segments are already marked on the molded blank such that the sequence is identified and can be ahered to.

It may be noted that shell containers already in use may inexpensively be provided with the novel centering support assembly as taught by the invention. A preferred embodiment of the invention is illustrated in the accompanying drawings and will be explained in detail hereunder with reference thereto.

DETAILED DESCRIPTION OF THE EMBODIMENT

Figure 1:
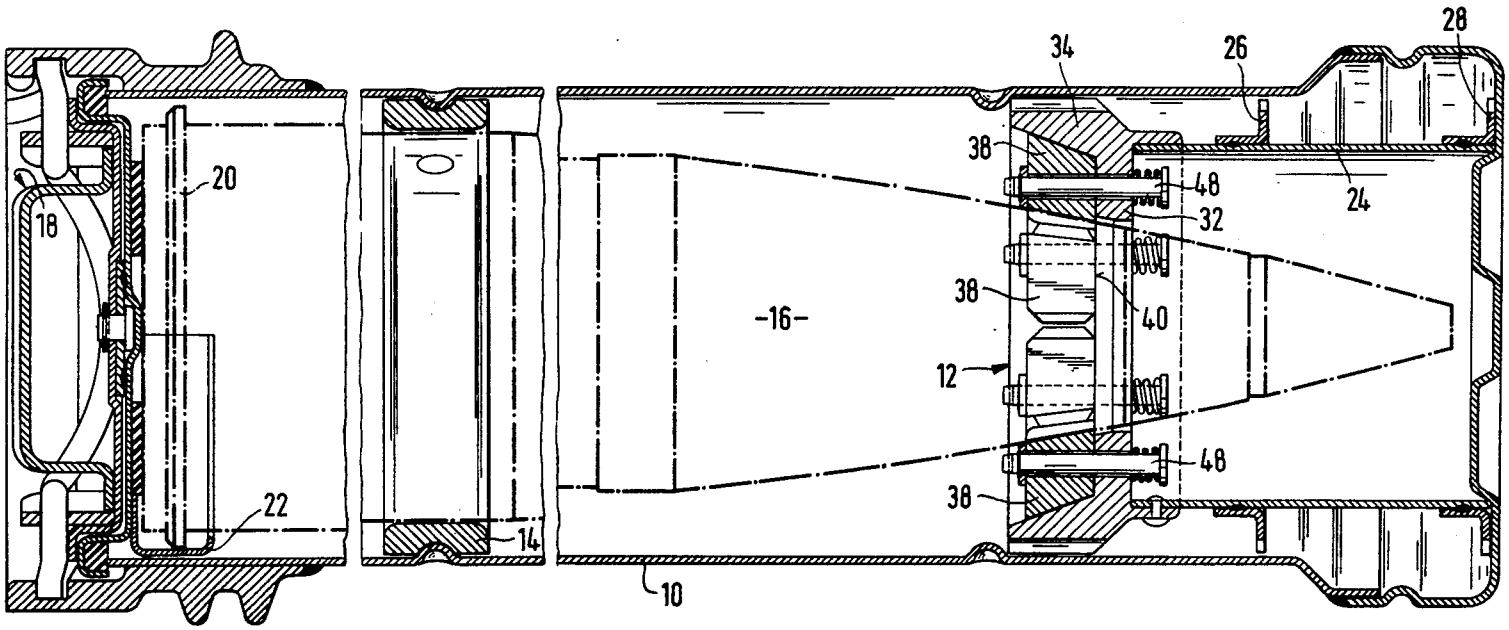
FIG. 1 is a longitudinal section view of reduced scale illustrating the cartridge container, the cartridge being indicated in dash-dotted lines.

An outer housing 10 is closed at its end adjacent the shell tip or ogive. The shell is supported by the centering assembly 12 and by an inner annulus 14 surrounding the cartridge case. In this manner, the shell is positively centered in the housing. The shell is axially urged into the centering assembly 12 by means of closure lid 18 disposed at the open end of the housing. The closure lid 18 does not form part of the present invention and need not be described in detail but it may be noted that it is provided with a claw 22 engaging cartridge collar 20 so that the shell may be pulled out of housing 10 by means of lid 18 once the latter has been unlocked.

Figure 2:
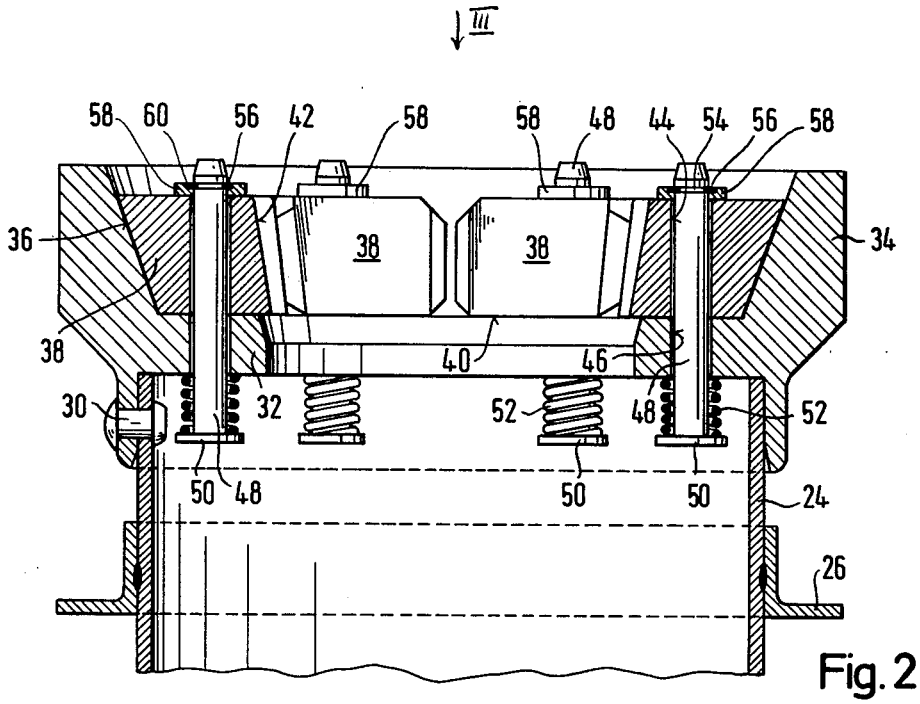
FIG. 2 is a 1:1 scale section view of the centering assembly.
Figure 3:
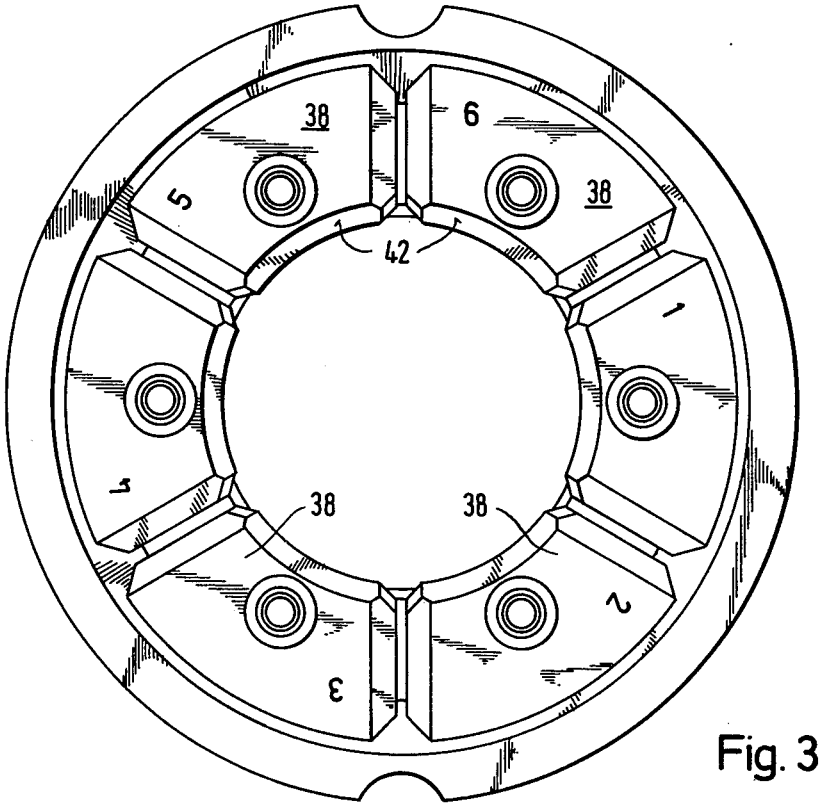
FIG. 3 is a front view seen in direction of arrow III in FIG. 2.

Centering assembly 12 is illustrated in detail in FIGS. 2 and 3. It comprises a support tube 24 welded to the adjacent housing closure, spacer rings 26 and 28 being spot-welded to tube 24. A plurality of rivets 30 (of which only one is shown in the drawings) connects an annular frame member to tube 24, the frame member comprising an inwardly protruding flange 32 and a sleeve portion 34 which has a cylindrical outer wall while its inner contour is trunconical. The apex angle of the cone defined by said trunconical contour is 36°.

Six ring segments 38 are provided having outer walls 36 complementary to the inner trunconical contour of sleeve portion 34, that is to say, each segment is outwards defined by a portion of a trunconical body having an apex angle of 36°. With the shell ogive seated between the segments 38, front face 40 of the segment abuts inner flange 32. The apex angle of 36° is sufficiently great that wedging cannot occur between sleeve 34 and segments 38 even if the engaging surfaces have a poor finish.

Wedging action, on the contrary, occurs at the inner surface 42 of segments 38, these inner surfaces extending under a much smaller apex angle complementary to that of the shell ogive. Upon pulling of a shell by means of claw 22, consequently, the shell ogive will readily carry away segments 38 which, in turn, will almost immediately release the shell because after a very short movement they are not supported outwardly any more.

It is not desired, however, that the segments will thereafter loosely remain in housing 10 because this would render the reinsertion of another shell rather difficult. Therefore, segments 38 are loosely connected to inner flange 32 and thus to the housing. Each segment is provided with a bore 44 parallel to the housing axis, and coaxial with said bores 44 there are holes 46 in inner flange 32. A rod 48 extends through each pair of aligned bores 44 and 46, and a coil spring is compression-biased between head 50 of each rod and inner flange 32. A resilient U-washer 56 is disposed in an annular groove 54 adjacent the free end of each rod extending beyond the respective segment 38. The U-washer in turn fits into a stop disc 58 and is radially secured by an upstanding collar 60 of the latter.

The segments are indeed made of one single piece which has been integrally molded, the mold providing already separation markings between the segments of the molded member. Further, in the mold numbers "1" through "6" for the respective segments are provided and will appear on the molded member which prior to segmentation is machined on a lathe. The sequence of numbers identifies the position of each segment in the machined member and will be reproduced during assembly. Segmentation is made by sawing so that there will be a gap between circumferentially juxtaposed segments permitting free alignment thereof upon insertion of the shell.

What I claim is:

1. A container for supporting a shell having an ogive portion, said container comprising: a substantially tubular housing, a shell centering assembly having conical support surface means which are complementary to the ogive portion of the shell being centered thereby, and a sleeve means mounted in said housing and supporting said shell centering assembly within said housing, said shell centering assembly being radially expansible upon the application of an axial force in one direction and unable to radially expand upon the application of an axial force in the opposite direction, such that upon the insertion of the shell into said housing, the ogive portion of the shell will engage the conical support surface means of said centering assembly, wedging the same between the ogive portion of the shell and said sleeve means, whereas upon the withdrawal of the shell from said housing, said centering assembly is radially expansible to release the shell.

2. The shell container as set forth in claim 1 wherein said sleeve means has a conical inner surface opening in the direction of said pulling force while said centering assembly has a conical outer surface complementary thereto, the apex angle of the complementary conical surfaces being substantially greater than the apex angle of said conical support surface means.

3. The shell container as set forth in claim 2 wherein the apex angle of the inner surface of the sleeve means and the apex angle of the outer surface of the centering assembly is between 30° to 50°.

4. The shell container as set forth in claim 3 wherein the apex angle of the inner surface of the sleeve means and the apex angle of the outer surface of the centering assembly is about 36°.

5. The shell container as set forth in claim 1 wherein said centering assembly comprises a plurality of ring segments.

6. The shell container of claim 5 wherein the sleeve means has an inwardly extending, radial flange at the narrow edge of the conical surface opening of the sleeve means and the ring segments which define the conical support surface means and are supported by the sleeve means, each have a front face which abuts said flange.

7. The shell container as set forth in claim 6 wherein the inner flange has a plurality of holes therethrough and each ring segment has a rod extending therefrom and through one of said holes to connect the respective segments to the inner flange, said rod being of such a length as to allow the displacement of each segment away from the inner flange by a predetermined distance.

8. The shell container as set forth in claim 7 wherein each rod has a head at its end opposite its segment and, a compression spring disposed between said head and said inner flange.

9. The shell container as set forth in claim 6 wherein said internal flange and said sleeve means form an integral member.

* * * * *